US007438669B1

(12) United States Patent
Bloom

(10) Patent No.: US 7,438,669 B1
(45) Date of Patent: Oct. 21, 2008

(54) HAND GRIP STRENGTHENING AND COMPETITION APPARATUS

(76) Inventor: Lawrence E. Bloom, 9842 E. San Salvador Dr., Scottsdale, AZ (US) 85258

( * ) Notice: Subject to any disclaimer, the term of this patent is extended or adjusted under 35 U.S.C. 154(b) by 389 days.

(21) Appl. No.: 11/329,496

(22) Filed: Jan. 10, 2006

(51) Int. Cl.
*A63B 23/16* (2006.01)
*A63B 15/02* (2006.01)
*A63B 21/02* (2006.01)

(52) U.S. Cl. ..... 482/49; 482/1; 482/126; 482/906

(58) Field of Classification Search ..... 482/1, 482/44, 49, 126, 905, 906, 57, 62, 122; 280/200; 601/36, 40; 273/451, 452, 460; 74/551.1–551.9; 446/484, 485; 473/202, 451, 453, 459, 463
See application file for complete search history.

(56) References Cited

U.S. PATENT DOCUMENTS 2,643,123 A * 6/1953 Spinks ..... 482/49
3,539,182 A 11/1970 Sieg
3,653,659 A * 4/1972 Zinkin ..... 482/49
3,759,512 A * 9/1973 Yount et al. ..... 482/62
4,039,185 A 8/1977 Rhodes
4,131,275 A 12/1978 Gandy et al.
4,798,377 A * 1/1989 White ..... 482/49
4,930,798 A * 6/1990 Yamazaki et al. ..... 280/261
4,943,047 A * 7/1990 Noble ..... 482/49
5,336,140 A 8/1994 LeBlond
5,472,400 A * 12/1995 Royer ..... 482/141
5,611,755 A 3/1997 Blackmore
5,769,426 A 6/1998 Gill
6,406,406 B1 * 6/2002 Onorati ..... 482/44
6,918,862 B1 7/2005 Comeau

* cited by examiner

*Primary Examiner*—LoAn H. Thanh
*Assistant Examiner*—Allana Lewin
(74) *Attorney, Agent, or Firm*—Parsons & Goltry; Michael W. Goltry; Robert A. Parsons

(57) ABSTRACT

A hand grip strengthening and competition apparatus includes first and second alarms and a power source carried by an elongate body. A first lever is mounted to the elongate body for pivotal movement between an open position and a closed position closing a first circuit between the power source and the first alarm energizing the first alarm. A second lever is spaced from the first lever and is mounted to the elongate body for pivotal movement between an open position and a closed position closing a second circuit between the power source and the second alarm energizing the second alarm. An elongate flexible, substantially non-stretchable connector has a first end attached to the first lever, a second end attached to the second lever, and length extending from the first end to the second end preventing the first and second levers from concurrently assuming their respective closed positions.

21 Claims, 8 Drawing Sheets

20
21
25
29
40
42
43
44
51
52
53
54
57
59
61
63
65
68
69
75
76
80
81
82
84
85
87
100
101A
102A
101B
102B

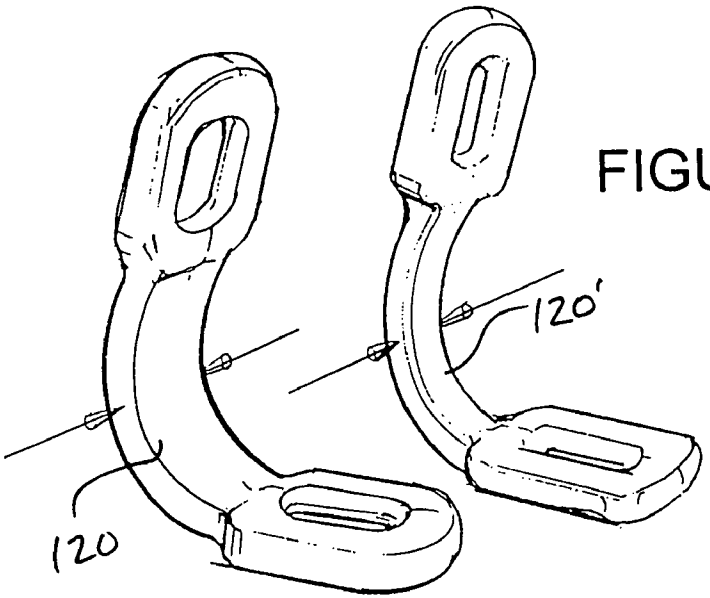
FIGURE 10
FIGURE 9
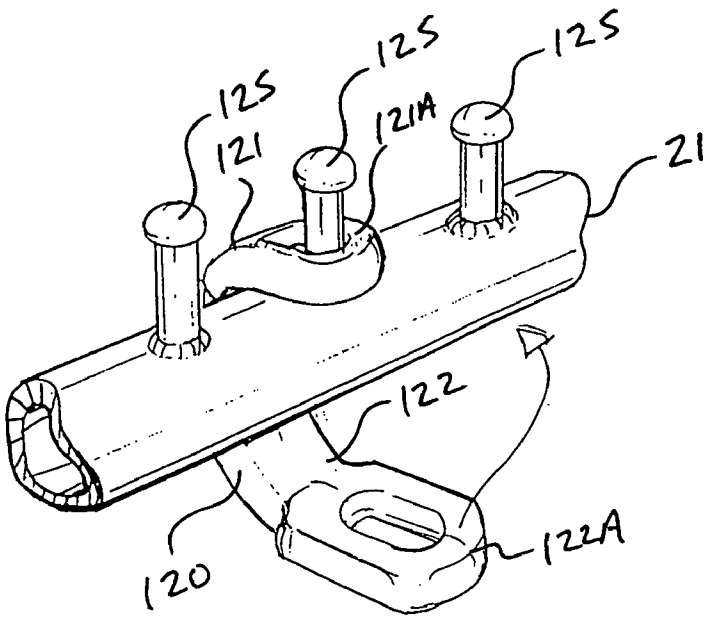
FIGURE 8

HAND GRIP STRENGTHENING AND COMPETITION APPARATUS

FIELD OF THE INVENTION

The present invention relates to exercise devices and, more particularly, to exercise devices for promoting exercise, for strengthening the hands and wrists, and for providing grip strength competition between competitors.

BACKGROUND OF THE INVENTION

Recent research suggests that most young people do not participate in enough exercise to reap health benefits. Recent technological advances, coupled with the reduction in the amount of time spent on physical education in schools, means that more and more children are involved in passive pursuits. However, games and physical activities are an important part of a child's life and constitute a crucial part of their health and well being.

Appropriate, regular physical activity in children can help to optimize physical fitness and current health and well being by promoting optimum growth, helping to prevent obesity, helping to reduce stress and anxiety, and helping to enhance self-esteem. A regular exercise regime also can help to develop active lifestyles that can be maintained throughout adult life. In fact, physically active children are more likely to be active adults, and active adults have a smaller risk of serious diseases such as coronary heart disease and diabetes.

In an effort to promote exercise among children and adults, skilled artisans have devoted considerable effort toward specialized exercise devices that are designed to not only promote exercise but also to make exercise comfortable and safe and that can be used in the home. Among the vast array of specialized exercise devices are specialized abdominal strengthening devices, arm strengthening devices, inner and outer thigh strengthening devices, devices designed to tighten and strengthen the gluteal muscles, and devices designed to strengthen the hand and wrists.

Maintaining proper hand and wrist strength is particularly important for preventing the onset of hand and wrist ailments, particularly carpal tunnel. As a result, the art is replete with many exercise devices that are particularly designed to strengthen the muscles of the hand, fingers, and wrist, primarily by the action of repeated hand gripping. Although skilled artisans have devoted considerable time and effort toward specialized hand and wrist strengthening devices, the results have not been entirely satisfactory. For example, known hand and wrist strengthening devices are difficult and expensive to construct, are not easy and comfortable to use, and are not designed to promote exercise among competitors. Given these and other disadvantages prevalent in the art of hand and wrist strengthening devices, the need for continued improvement is evident.

SUMMARY OF THE INVENTION

According to the invention, a hand grip exercising and competition apparatus includes first and second alarms and a power source carried by an elongate body. A first lever is mounted to the elongate body for pivotal movement between an open position and a closed position closing a first circuit between the power source and the first alarm energizing the first alarm. A second lever, spaced from the first lever, is mounted to the elongate body for pivotal movement between an open position and a closed position closing a second circuit between the power source and the second alarm energizing the second alarm. An elongate flexible, substantially non-stretchable connector has a first end attached to the first lever, a second end attached to the second lever, and length extending from the first end to the second end preventing the first and second levers from concurrently assuming their respective closed positions. An intermediate portion of the connector extends between the first and second levers opposing the elongate body. Elastic band material concurrently encircles the intermediate portion of the connector and the elongate body drawing the intermediate portion toward the elongate body biasing the first and second levers in their open positions, respectively. A stop attached to the intermediate portion of the connector on either side of the elastic band material captures the elastic band material therebetween. Preferably, the elastic band material includes at least one elastic band, and the power source consists of at least one battery.

According to the invention, a hand grip exercising and competition apparatus includes first and second alarms, first and second contacts, and a power source carried by an elongate body. A first lever is formed with a first lever contact, and is mounted to the elongate body for pivotal movement between an open position and a closed position engaging the first lever contact with the first contact closing a first circuit between the power source and the first alarm energizing the first alarm. A second lever is formed with a second lever contact, is spaced from the first lever, and is mounted to the elongate body for pivotal movement between an open position and a closed position engaging the second lever contact with the second contact closing a second circuit between the power source and the second alarm energizing the second alarm. An elongate flexible, substantially non-stretchable connector has a first end attached to the first lever, a second end attached to the second lever, and length extending from the first end to the second end preventing the first and second levers from concurrently assuming their respective closed positions. An intermediate portion of the connector extends between the first and second levers, opposes the elongate body, and is elastically coupled to the elongate body thereby biasing the first and second levers in their open positions, respectively. Preferably, the intermediate portion is elastically coupled to the elongate body with elastic band material concurrently encircling the elongate body and the intermediate portion of the material. A stop attached to the intermediate portion of the connector on either side of the elastic band material captures the elastic band material therebetween. Preferably, the elastic band material includes at least one elastic band, and the power source consists of at least one battery.

According to the invention, a hand grip exercising and competition apparatus includes an elongate body having opposed first and second ends, a first grip formed at the first end of the elongate body, and a second grip formed at the second end of the elongate body. First and second alarms and a power source are carried by the elongate body. A first contact is carried by the first grip, and a second contact is carried by the second grip. A first lever is formed with a first lever contact, and is mounted to the elongate body for pivotal movement between an open position away from the first grip and a closed position toward the first grip engaging the first lever contact with the first contact closing a first circuit between the power source and the first alarm energizing the first alarm. A second lever is formed with a first lever contact, and is mounted to the elongate body for pivotal movement between an open position away from the second grip and a closed position toward the second grip engaging the second lever contact with the second contact closing a second circuit between the power source and the second alarm energizing the second alarm. An elongate flexible, substantially non-stretchable connector has a first end attached to the first lever, a second end attached to the second lever, and length extending from the first end to the second end preventing the first and second levers from concurrently assuming their respective closed positions. An intermediate portion of the connector extending between the first and second levers opposing the elongate body is elastically coupled to the elongate body thereby biasing the first and second levers in their open positions, respectively. Preferably, the intermediate portion is elastically coupled to the elongate body with elastic band material concurrently encircling the elongate body and the intermediate portion of the material. A stop attached to the intermediate portion of the connector on either side of the elastic band material captures the elastic band material therebetween. Preferably, the elastic band material includes at least one elastic band, and the power source consists of at least one battery.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings:

FIG. 8 is a fragmented perspective view of a portion of an elongate body of an apparatus constructed and arranged in accordance with the principle of the invention shown configured with pins for securing ends of elastic bands;

FIGS. 9 and 10 are perspective views of elastic bands for use with the apparatus of FIG. 1.

DETAILED DESCRIPTION OF PREFERRED EMBODIMENT

Figure 1:
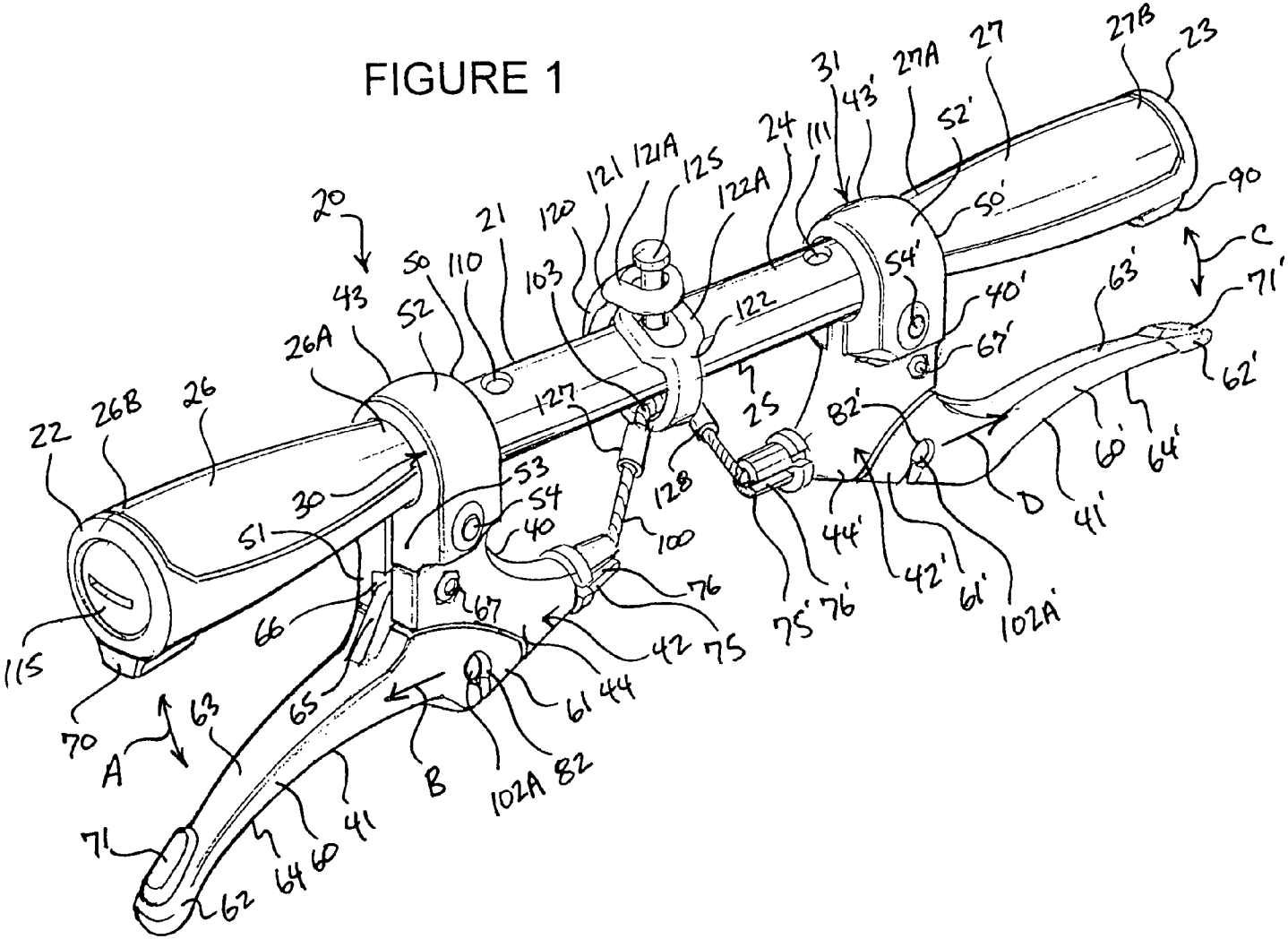
FIG. 1 is a perspective view of a hand grip strengthening and competition apparatus constructed and arranged in accordance with the principle of the invention including a connector interconnecting opposed levers mounted for pivotal movement to an elongate body.

Turning now to the drawings, in which like reference characters indicate corresponding elements throughout the several views, attention is first directed to FIG. 1 in which there is seen a grip strengthening and competition apparatus 20 including an elongate body 21 having opposing ends 22 and 23, and opposing upper and lower sides 24 and 25. Body 21 is formed of hard plastic, aluminum, steel, wood, or other substantially rigid material or combination of materials, and is either integrally formed or fashioned from a plurality of attached parts secured together with glue and or fasteners, such as threaded fasteners, nut-and-bolt assemblies, rivets, etc.

Hand grips 26 and 27 are formed in elongate body 21 at ends 22 and 23, respectively. Grips 26 and 27 are simply enlarged and somewhat ergonomically shaped features of elongate body 21 making them each comfortable to take up and grip by hand. Grips 26 and 27 can incorporate, either partially or totally, a rubberized and/or cushioned exterior surface to enhance grip and comfort, if desired. For the purpose of orientation and reference, it is to be understood that grip 26 has opposing inner and outer ends 26A and 26B, and that grip 27 has opposing inner and outer ends 27A and 27B.

Elongate body 21 supports opposed lever assemblies 30 and 31. Lever assemblies 30 and 31 are identical to one another. Accordingly, only lever assembly 30 will be discussed in detail, with the understanding that the ensuing discussion of lever assembly 30 applies equally to lever assembly 31.

Figure 2:
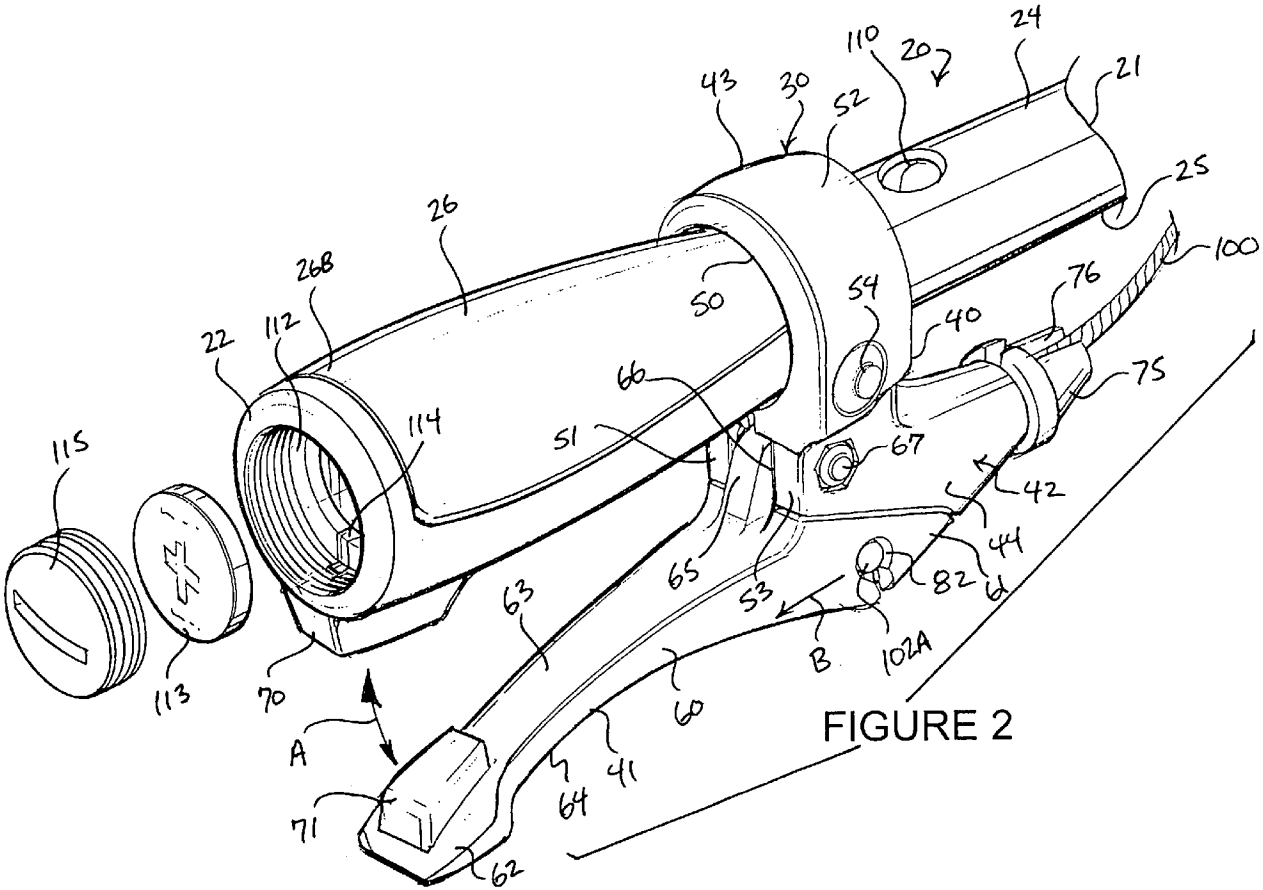
FIG. 2 is an enlarged fragmented, partially exploded perspective view of the apparatus of FIG. 1 illustrating a cap and a power source.

Referring to FIG. 2, lever assembly 30 consists of a support 40 rigidly secured to elongate body 21, and a lever 41 mounted to support 40 for pivotal movement in reciprocal directions as indicated by the arcuate double arrowed line A. Support 40 consists of a body 42 having an upper end 43 affixed to elongate body 21 and an opposing lower end 44. Upper end 43 is characterized by a coupling 50, which secures support to elongate body 21. Coupling 50 has an end 51 located at lower side 25 of elongate body 21, an intermediate portion 52 encircling elongate body 21 at inner end 26A of grip 26, and an end 53 located at lower side 25 of elongate body 21 opposing end 51. Ends 51 and 53 are secured together with a threaded fastener 54, which is tightened thereby rigidly clamping intermediate portion 52 to elongate body 21.

Lever 41 consists of an elongate member 60 having opposing inner and outer ends 61 and 62, an upper face 63 facing grip 26 and an opposing lower face 64. Elongate member 60 is formed with a tongue 65, which is located between inner and outer ends 61 and 62. Tongue 65 projects away from upper face 63 and into a bifurcated feature 66 formed in lower end 44 of coupling 50. A pivot pin 67 passes concurrently through lower end of coupling 50 and tongue 65 pivotally attaching lever 41 to lower end 44 of body 42 of support 40. Lever 60 opposes and is spaced from lower side 25 of elongate body 21 and, moreover, opposes, is spaced from, and is substantially coextensive relative to, grip 26. Outer end 62 of lever 41 opposes outer end 26B of grip 26. Lever 41 pivots in reciprocal directions relative to grip 26 as indicated by arcuate double arrowed line A between open position and closed positions.

A contact 70 is mounted to lower side 25 of elongate body 21 at outer end 26B of grip 26. A corresponding lever contact 71 is mounted to upper face 63 of lever 41 at outer end 62 thereof. In its open position, inner end 61 of lever 41 rests against lower end 44 of support 40 and outer end 62 of lever 41 is disposed away from outer end 26B of grip 26. In its closed position, inner end 61 is drawn away from lower end 44 of support 40 in the direction indicated by the arrowed line B (shown also in FIG. 1), and outer end 62 of lever 41 is drawn toward outer end 26B of grip 26 bringing lever contact 71 into engagement with contact 70, in accordance with the principle of the invention.

Figures 3, 4:
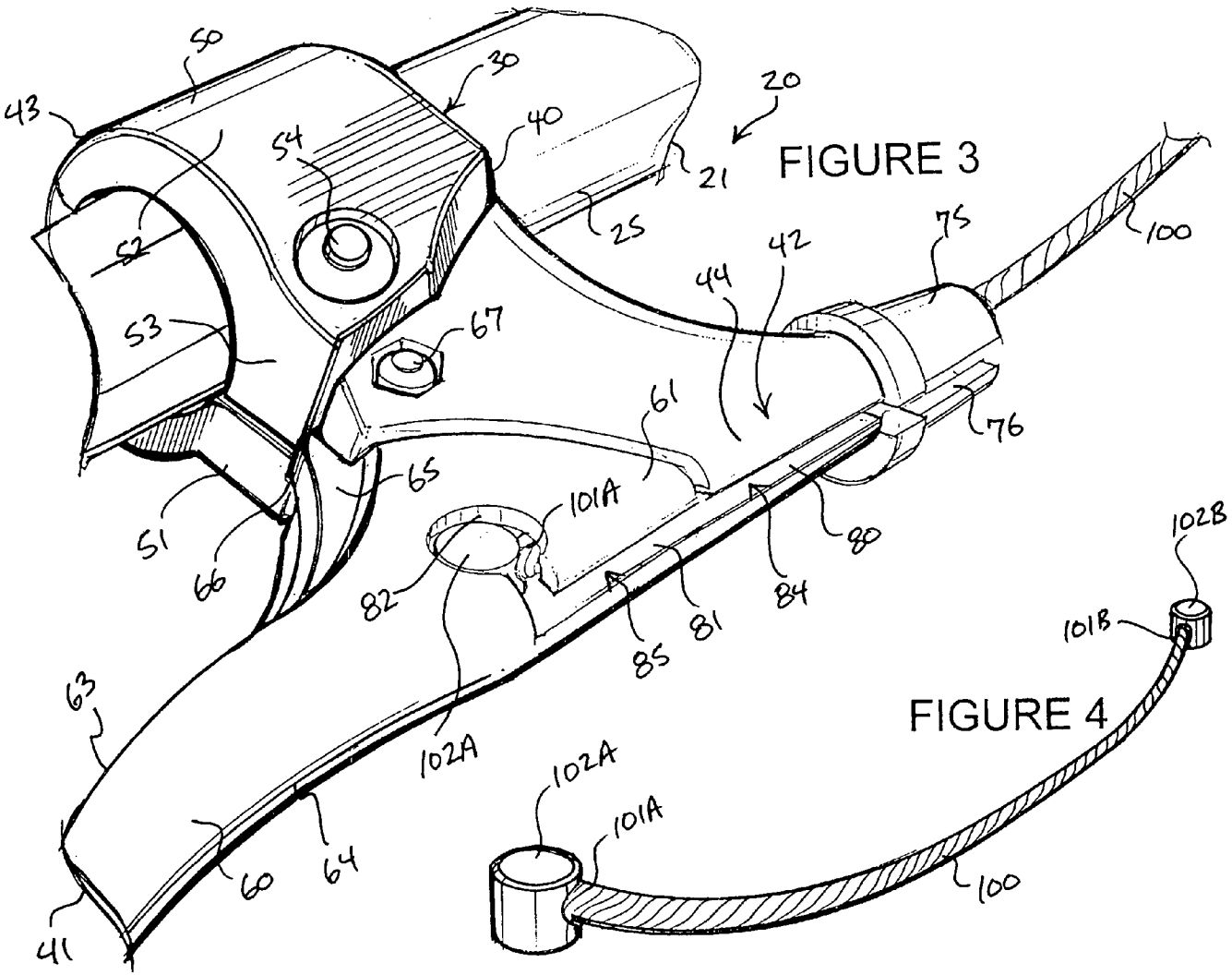
FIG. 3 is an enlarged perspective view of the apparatus of FIG. 1 illustrating the attachment of an end of the connector to a lever.
FIG. 4 is a perspective view of the connector of FIG. 3.

Looking now to FIG. 3, lower end 44 of support 40 projects away from inner end 61 of lever 41 and terminates with a nipple 75, which is hollow and severed forming a gap 76 therein. Nipple 75 is rotated to lower end 44 of support 40 with a conventional journaled engagement, threaded engagement, or the like. The underside of lower end 44 of support 40 and inner end 61 of elongate member 60 are severed forming corresponding aligned gaps 80 and 81 therein. Gap 81 terminates with a receptacle 82. Gap 80 leads to a channel 84 formed in lower end 44 of support 40 and gap 81 leads to a corresponding channel 85 formed in inner end 61 of elongate member 60.

As previously mentioned, lever assembly 31 is identical in every respect to lever assembly 30, and in FIG. 1 common reference characters used to describe the various structural features thereof are applied to lever assembly 31 for reference purposes. For clarity, however, the common references characters associated with lever assembly 31 each incorporate prime ("") designations. Lever assembly 31 is spaced from and confronts lever assembly 30, and is the mirror image of lever assembly 30 as substantially shown. Coupling 50' of lever assembly 31 encircles elongate body 21 at inner end 27A of grip 27. Lever 60' opposes and is spaced from lower side 25 of elongate body 21 and, more particularly, opposes, is spaced from, and is substantially coextensive relative to, grip 27. Levers 60 and 60' of lever assemblies 30 and 31 reside in a common vertical plane along lower side 25 of elongate body 21. Outer end 62' of lever 41' of lever assembly 31 opposes outer end 27B of grip 27. Lever 41' pivots in reciprocal directions relative to grip 27 as indicated by arcuate double arrowed line C between open position and closed positions.

A contact 90 is mounted to lower side 25 of elongate body 21 at outer end 27B of grip 27. In its open position, inner end 61' of lever 41 of lever assembly 31 rests against lower end 44 of support 40 and outer end 62' of lever 41' is disposed away from outer end 27B of grip 27. In its closed position, inner end 61' of lever 41' of lever assembly 31 is drawn away from lower end 44 of support in the direction indicated by the arrowed line D, and outer end 62' of lever 41' is drawn toward outer end 27B of grip 27 bringing lever contact 71 into engagement with contact 90.

According to the principle of the invention, a connector 100 interconnects inner ends 61 and 61' of levers 41 of lever assemblies 30 and 31, respectively. The attachment of an end of connector 100 to lever 41 of lever assembly 30 will now be discussed, with the understanding that the ensuing discussion also applies to the attachment of the opposing end of connector 100 to lever 41' of lever assembly 31'.

Referring to FIG. 4, connector 100 is elongate, flexible, and substantially non-stretchable. Preferably, connector 100 is a small diameter cord fashioned of numerous strands woven or twisted together. The strands may be fashioned of steel, thread, yard, or the like that when formed into a cord form an elongate, flexible, and substantially non-stretchable connector. Any form of elongate, flexible, and substantially non-stretchable material can be used to form connector 100 without departing from the invention.

Connector 100 has opposed ends 101A and 101B formed with enlarged heads 102A and 102B, respectively. Connector 100 has a length L extending from end 101A to end 101B. To attach connector 100 to inner end 61 of lever 41 of lever assembly 30 as shown in FIG. 3, nipple 75 is rotated to align or register its gap 76 with gap 80. A length of connector 100 toward end 101A is taken up and passed into nipple 75 and channels 84 and 85 through gaps 76, 80, and 81, and head 102A is set into receptacle 82 thereby securing end 101A of connector 100 in place to inner end 61 of elongate member 60. Nipple 75 is then rotated taking its gap 76 out of alignment relative to gap 80. As seen in FIG. 1, head 102A of end 101B of connector 100 is secured to lever 41' of lever assembly 31 in exactly the same way, in which connector 100 passes between nipples 75 and 75' from lever 41 of lever assembly 30 to lever 41' of lever assembly 31. It is to be understood that the portion of connector 100 extending between nipples 75 and 75' is considered an intermediate portion 103 of connector 100.

In their open positions, inner ends 61 and 61' of levers 41 and 41' of lever assemblies 30 and 31 rests against the lower ends 44 and 44' of their respective supports 40 and 40' bringing heads 102A and 102B and ends 101A and 101B of connector 100 toward one another and thereby introducing slack into intermediate portion 103 of connector 100 between nipples 75 and 75'. When levers 41 and 41' of lever assemblies 30 and 31 are concurrently moved out of their open positions and toward their closed positions, heads 102A and 102B and the corresponding ends 101A and 101B of connector 100 are drawn apart thereby eliminating the slack in intermediate portion 103 and introducing tension in connector 100 at its intermediate portion 103. Length L of connector 100 is of such a dimension that the non-stretchable character of connector 100 prevents levers 41 of lever assemblies 30 and 31 from concurrently assuming their respective closed positions, in accordance with the principle of the invention.

Referring to FIG. 1, elongate body supports alarms 110 and 111. Alarm 110 is disposed in proximity to grip 26, and alarm 111 is disposed in proximity to grip 27. In this embodiment, alarm 110 is located adjacent to inner end 26A of grip 26 on the opposing side of coupling 50 of lever assembly 30, and alarm 111 is located adjacent to inner end 27A of grip 27 on the opposing side of coupling 50 of lever assembly 31. Alarms 110 and 111 can be located elsewhere, if desired, and it is preferred that each be located proximate to its respective handle. Looking to FIG. 2, end 22 of elongate body 21 is formed with a battery compartment 112 that is adapted to accept a battery 113. Elongate body 21 is formed with conventional electrical wiring/circuitry 114, which provides and defines a circuit between battery 113, contact 70 and alarm 110, and a circuit between battery 113, contact 90, and alarm 111. End 22 of elongate body 21 has a threaded cap 115 that is used to enclose battery 113 in compartment and that may be easily removed for replacing battery 113 as needed. In the immediate embodiment, battery 113 is a 1.5 volt watch battery, and although there is only one shown in this example it is to be understood that more can be used, if desired. Also, although a 1.5 volt watch battery is disclosed as a preferred power source of apparatus 10, it is to be understood that other battery forms can be used without departing from the invention, such as one or more nickel-cadmium batteries, lithium-ion batteries, alkaline batteries, etc. Battery compartment 112 is formed into end 22 of elongate body 21 as a matter of example, and it is to be understood that it can be formed elsewhere, if desired.

Looking back now to FIG. 1, an elastic band 120 is positioned squarely between lever assemblies 30 and 31, and concurrently encircles elongate body 21 between lever assemblies 30 and 31 and intermediate portion 103 of connector between nipples 75 and 75'. Elastic band 120 is fashioned of rubber, bungee cord material, or the like, is elongate and has opposed ends 121 and 122 formed with loops 121A and 122A, respectively. Elongate body 21 supports an upstanding headed pin 125, which projects upwardly from upper side of elongate body 21 between lever assemblies 30 and 31. Elastic band 120 concurrently encircles elongate body 21 between lever assemblies 30 and 31 and intermediate portion 103 of connector between nipples 75 of lever assemblies 30 and 31 and pin 125 passes concurrently through loops 121A and 122A thereby securing elastic band 120 in place.

Elastic band 120 elastically couples intermediate portion 103 of connector 100 to elongate body 21 drawing intermediate portion 103 toward lower side 25 of elongate body and thereby drawing heads 102A and 102B and corresponding ends 101A and 101B of connector 100 toward one another thereby biasing levers 41 of lever assemblies 30 and 31 into their open positions, respectively, in accordance with the principle of the invention. Collars 127 and 128 encircle intermediate portion 103 on either side of elastic band 120 and act as stops capturing elastic band 120 therebetween.

FIGS. 1 A*nd* 5 show apparatus 20 at rest in preparation for use, in which elastic band 120 is acting on intermediate portion 103 of connector 100 drawing it toward lower side 25 of elongate body drawing heads 102A and 102B and corresponding ends 101A and 101B of connector 100 toward one another thereby biasing levers 41 and 41' of lever assemblies 30 and 31 into their open positions, respectively. To use apparatus 20, a first user presents the palm of his right or left hand onto grip 26 with the thumb positioned next to coupling 50 and extends his fingers outwardly securing lever 41, and a second user presents the palm of his right or left hand onto grip 27 with the thumb positioned next to coupling 50' and extends his fingers outwardly securing lever 41'. It will be readily understood that the manner in which grips 26 and 27 and levers 41 and 41' of lever assemblies 30 and 31 are taken up by hand is exactly the same way one may grip the handles and corresponding brake and clutch levers of a conventional motorcycle. At this point, apparatus 20 may be employed for its intended purpose.

Figure 6:
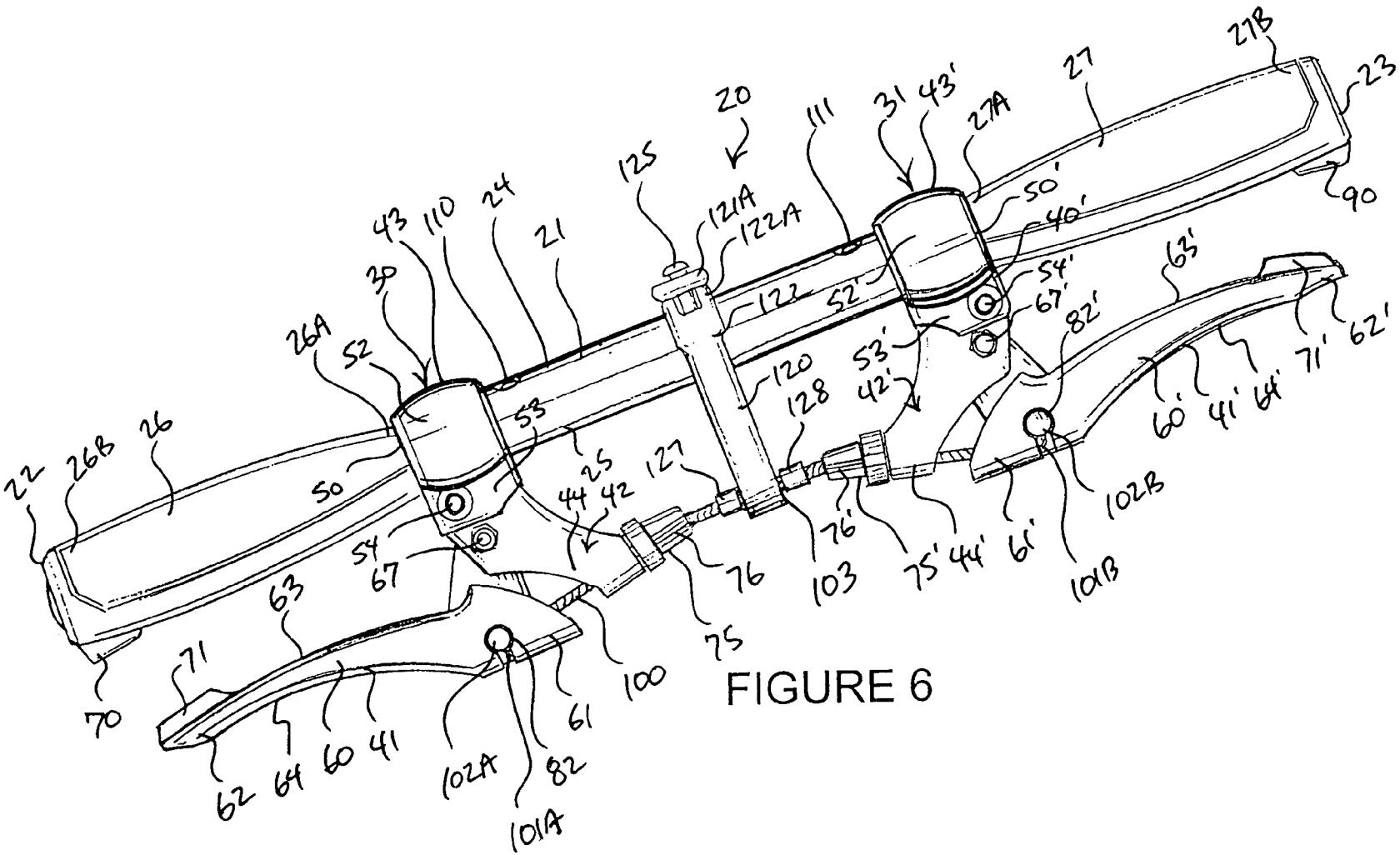
FIG. 6 is a side elevational view of the apparatus of FIG. 1 shown as it would appear in an intermediate tensioned position.

With the first user securing by hand grip 26 and lever 41 of lever assembly 30 and the second user securing by hand grip 27 and lever 41' of lever assembly 31, each commences to apply a forcible grip concurrently drawing levers 41 and 41' out of their respectively open positions and toward their respective closed positions. As levers 41 and 41' are concurrently moved out of their respective open positions and toward their respective closed positions, inner ends 61 and 61' of levers 41 and 41' are drawn away from each other, in which inner end 61 of lever 41 of lever assembly 30 is drawn away from lower end 44 of support 40 in the direction indicated by the arrowed line B, and inner end 61' of lever 41' of lever assembly 30 is concurrently drawn away from lower end 44' of support 40' in the direction indicated by the arrowed line C. As inner ends 61 and 61' are pulled away from each other, ends 101A and 101B of connector also pulled away from one another taking up the slack in intermediate portion 103 and pulling connector 100 tight drawing intermediate portion 103 away from lower side 25 of elongate body 21 as shown in FIG. 6. It is to be understood that the gripping force applied to levers 41 and 41' is sufficient to overcome the bias applied by elastic band 120, and that when levers 41 and 41' are moved out of their respective open positions and toward their respective closed positions that elastic band 120 is stretched as shown in FIG. 6.

Figure 7:
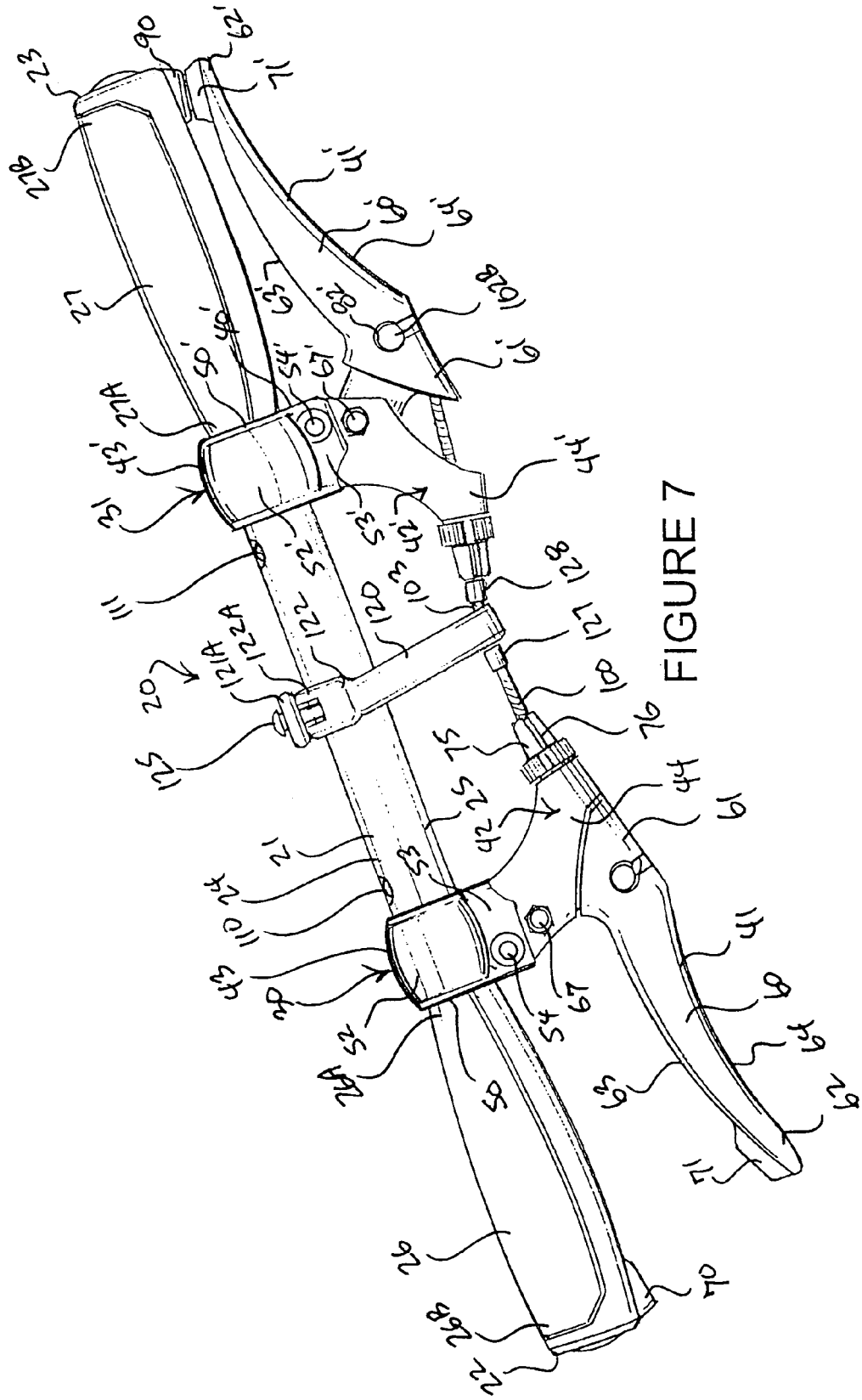
FIG. 7 is a side elevational view of the apparatus of FIG. 1 shown as it would appear in a winning position.

In FIG. 7, levers 41 and 41' are shown positioned between their respective open and closed positions, in which elastic band 120 is stretched by the pivoting of levers 41 and 41' and connector 100 is under an applied tension being pulled straight between nipples 75 and 75'. Because connector 100 is substantially non-stretchable and its length L prevents levers 41 and 41' from concurrently assuming their respective closed positions, a gripping battle now ensues between the respective users, in which the first user to overcome the other and bring his lever into its closed position is considered the winner and the one with the stronger grip. In this battle, which is essentially of tug-of-war, each user grips as hard as he can in an effort to bring his lever into its closed position and overcome the grip of the competing user, each user acting on his lever pulling against each other at the opposite ends 101A and 101B of connector 100. When one of the users brings his lever into its closed position overcoming the grip of the competing user, apparatus 20 assumes what is considered a winning position as shown in FIG. 7.

Figure 5:
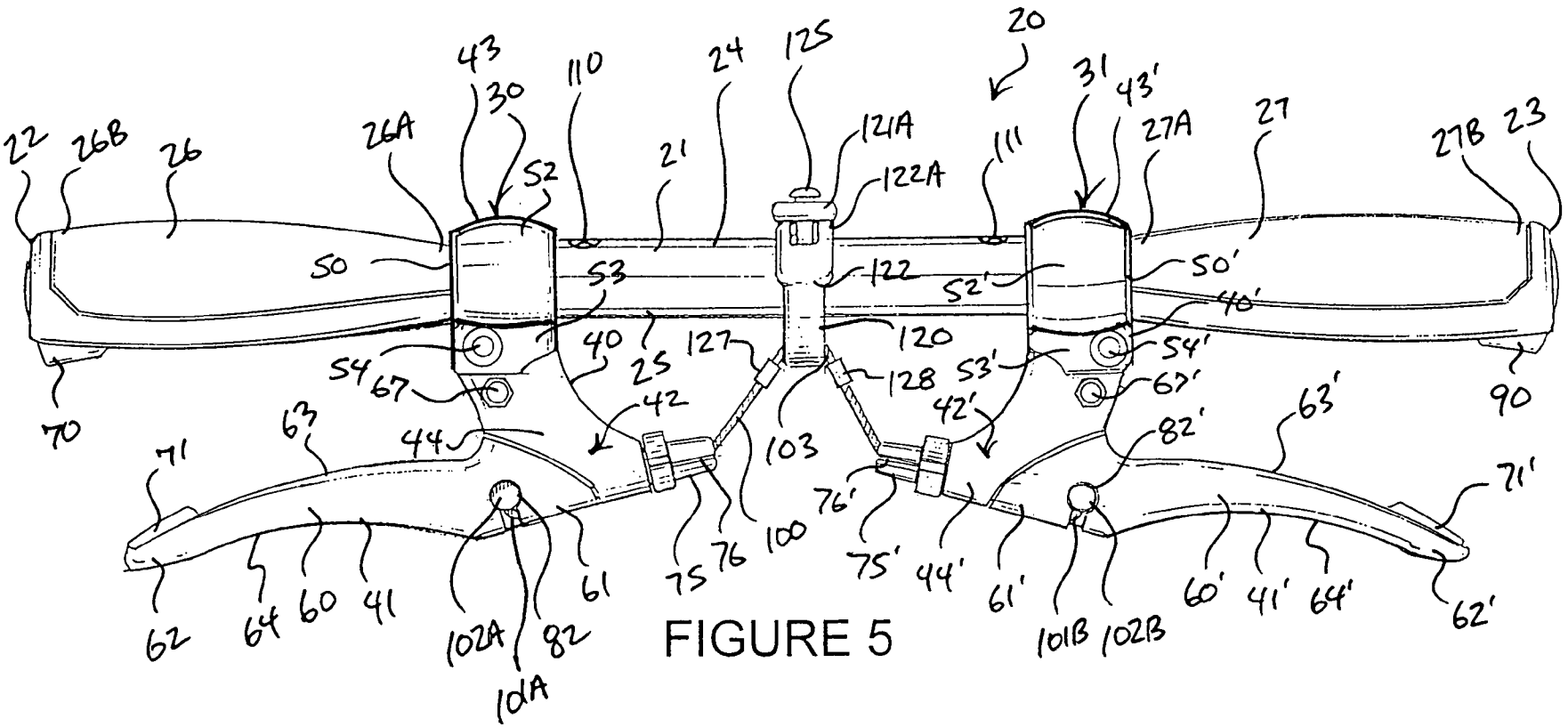
FIG. 5 is a side elevational view of the apparatus of FIG. 1 shown as it would appear in a starting position.

In FIG. 7, lever 41' is disposed in its closed position engaging its lever contact 71' to contact 90 at grip 27. When contact 71' contacts contact 90, a circuit provided by circuitry 114 (FIG. 2) is closed energizing alarm 111. When alarm 111 is energized, it issues a stimulus indicating a win corresponding to lever 41'. Alarm 111 is preferably a lamp, such as a light emitting diode or other similar lamp form, that when energized issues a stimulus in the form of illumination. Although FIG. 7 shows apparatus 20 in a winning position corresponding to lever 41', this is simply shown as a matter of example. In a winning position of apparatus 20 corresponding to lever 41 of lever assembly 30, lever 41 is disposed in its closed position engaging its 71 contact with contact 70 at grip 26. When contact 71 contacts contact 70, a circuit provided by circuitry 114 (FIG. 2) is closed energizing alarm 110. When alarm 110 is energized, it issues a stimulus indicating a win corresponding to lever 41. Alarm 110, like alarm 111, is preferably a lamp, such as a light emitting diode or other similar lamp form, that when energized issues a stimulus in the form of illumination. Although alarms 110 and 111 are lights that when energized issue light or illumination, they may be configured as buzzers or speakers that when energized issue an audible stimulus. After a win with apparatus 20 is achieved, the users may release their grips causing elastic band 120 to act on intermediate portion 103 of connector and draw levers 41 and 41' back to their respective opening positions as shown in FIG. 5 placing apparatus 20 back into its resting or starting position. At this point, apparatus 20 may be reused as described. Although apparatus 20 is exemplary for providing grip competition between competing users, it may be used simply as a hand and wrist exercising device for strengthening hand gripping strength and for exercising the muscles of the hands, wrists and forearms through gripping, in which a single user may take up apparatus 20 with his left and right hands and grippingly act on levers 41 and 41', respectively, for providing gripping exercise to the hands.

As previously mentioned, the provision of elastic band 120 elastically couples intermediate portion 103 to elongate body 21 and biases levers 41 and 41' into their respective open positions thereby placing apparatus 20 in what is considered a resting or starting position. Although apparatus 20 incorporates one elastic band, it may incorporate more, if desired, for increasing the applied bias. If a plurality of bands 120 are employed, they may each be mounted, one by one, to apparatus 20 using pin 125. If desired, and with reference to FIG. 8, elongate body 21 may be configured with a plurality of upstanding pins 125 for allowing a multiplicity of elastic bands 120 to be attached as herein described.

In order to control the bias applied to intermediate portion 103 of connector 100, elastic bands of varying sizes or degrees of thickness may be used. As a matter of example, FIGS. 9 and 10 show elastic bands, that although identical in structure, have different thicknesses. Elastic band 120 in FIG. 9 has a greater thickness that that of elastic band 120' in FIG. 10. As a result, the bias capable of being applied by elastic band 120 is greater than the bias capable of being applied by elastic band 120'.

Although in the preferred embodiment elastic band 120 has free ends that are secured with pin 125, it may be formed as an endless band concurrently encircling elongate body 21 and intermediate portion 103 of connector 100. A plurality of such endless elastic bands may also be used, if desired. In another embodiment, an elastic cord may be repeatedly and concurrently wound about elongate body 21 and intermediate portion 103 and then its end secured to provide the applied bias. Those of ordinary skill will readily appreciate that any form of elastic band material or other biasing device may be used to elastically couple intermediate portion 103 to elongate body 21 for providing the applied bias to intermediate portion 103 as herein described.

The invention has been described above with reference to a preferred embodiment. However, those skilled in the art will recognize that changes and modifications may be made to the embodiment without departing from the nature and scope of the invention. For instance, elongate body 21 can be can be configured with one or more bands of lights applied to upper side 24, such as one or more bands or strips of light emitting diodes of the like, that operate in conjunction with levers 41 and 41' sequentially illuminating withdrawing and advancing relative to alarms 110 and 111, respectively, indicating movement of levers 41 and 41' between their respective open and closed positions. In this example, the lights of a band of lights will illuminate sequentially toward one of the alarms as the corresponding lever is moved from its open position to its closed position, and the lights of the band of lights will illuminate sequentially away from one of the alarms as the corresponding lever is moved from its closed position to its open position. Also, apparatus 20 may be configured with conventional pressure gauges for indicating the amount of gripping force applied to levers 41 and 41'.

Figure 11:
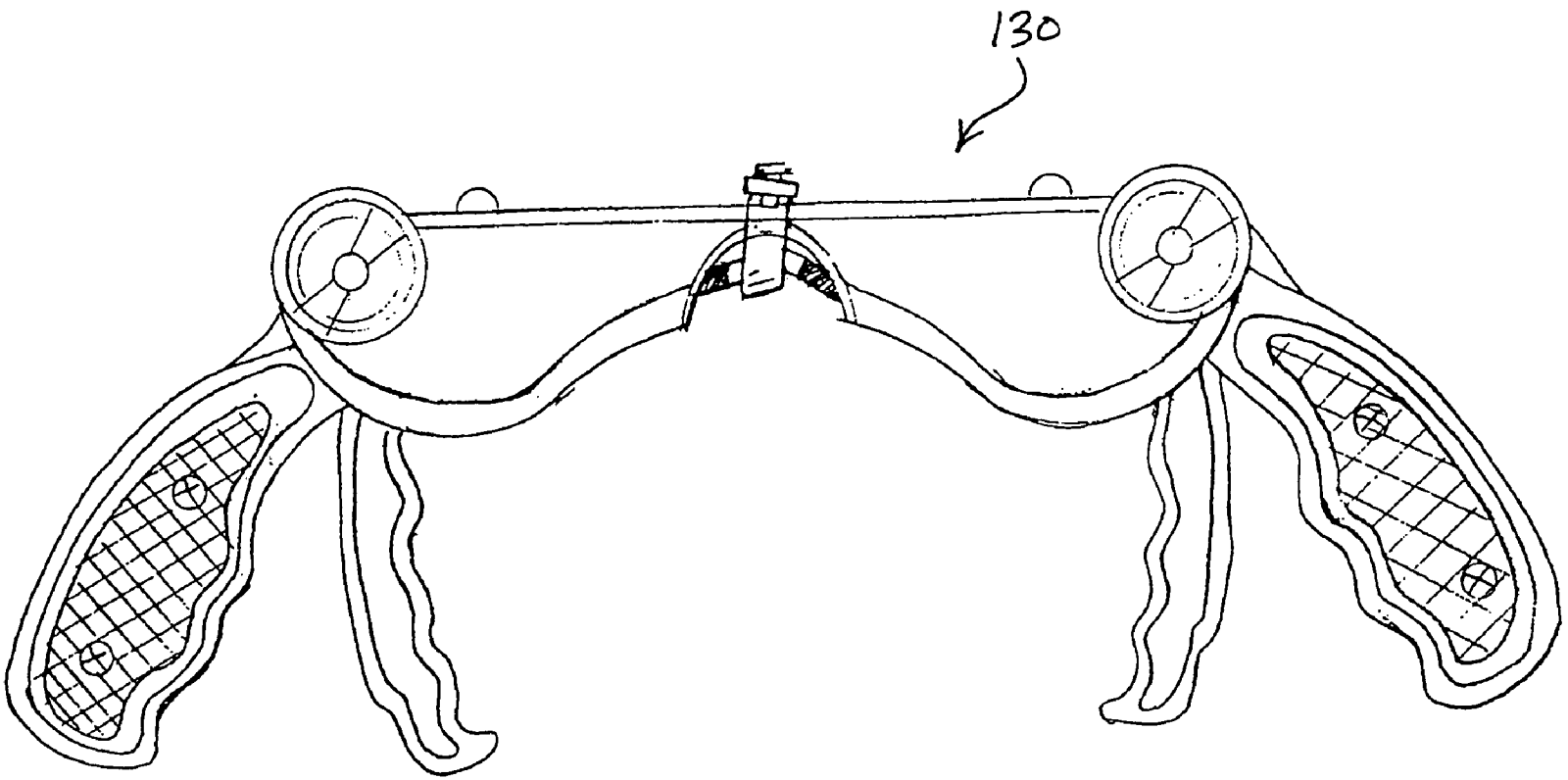
FIG. 11 is a side elevational view of an alternate embodiment of a hand grip strengthening and competition apparatus constructed and arranged in accordance with the principle of the invention.

Also, an apparatus constructed and arranged in accordance with the principle of the invention may be configured with various shapes and designs. Also, the grips and corresponding lever assemblies of an apparatus constructed and arranged in accordance with the principle of the invention may be oriented any desired angle relative to one another without departing from the invention. As a matter of example, FIG. 11 is a side elevational view of an apparatus 130 that is identical in every respect to apparatus 20, and that yet incorporates a different design and that shows the handles and corresponding lever assemblies angled inwardly toward one another. Because apparatus 130 is structurally identical to apparatus 20, it is to be understood that the foregoing discussion of apparatus 20 applies equally to apparatus 130, and that the illustration of apparatus 130 is shown only for the purpose of setting forth an alternate design of an apparatus constructed and arranged in accordance with the principle of the invention.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus, comprising:

an elongate body;

first and second alarms and a power source carried by the elongate body;

a first lever mounted to the elongate body for pivotal movement between an open position and a closed position closing a first circuit between the power source and the first alarm energizing the first alarm;

a second lever, spaced from the first lever, mounted to the elongate body for pivotal movement between an open position and a closed position closing a second circuit between the power source and the second alarm energizing the second alarm; and an elongate flexible, substantially non-stretchable connector having a first end attached to the first lever, a second end attached to the second lever, and length extending from the first end to the second end preventing the first and second levers from concurrently assuming their respective closed positions.

2. Apparatus according to claim 1, further comprising:

an intermediate portion of the connector extending between the first and second levers opposing the elongate body; and means coupling the intermediate portion of the connector to the elongate body drawing the intermediate portion toward the elongate body biasing the first and second levers in their open positions, respectively.

3. Apparatus according to claim 1, wherein the means comprises elastic band material concurrently encircling the elongate body and the intermediate portion of the material.

4. Apparatus according to claim 3, wherein the elastic band material further comprises at least one elastic band.

5. Apparatus according to claim 3, further comprising a stop attached to the intermediate portion of the connector on either side of the elastic band material capturing the elastic band material therebetween.

6. Apparatus according to claim 1, wherein the power source comprises at least one battery.

7. Apparatus according to claim 1, further comprising:

the elongate body having opposed sides; and the first and second levers confronting one of the opposed sides.

8. Apparatus, comprising:

an elongate body;

first and second alarms, first and second contacts, and a power source carried by the elongate body;

a first lever, formed with a first lever contact, mounted to the elongate body for pivotal movement between an open position and a closed position engaging the first lever contact with the first contact closing a first circuit between the power source and the first alarm energizing the first alarm;

a second lever, formed with a second lever contact and spaced from the first lever, mounted to the elongate body for pivotal movement between an open position and a closed position engaging the second lever contact with the second contact closing a second circuit between the power source and the second alarm energizing the second alarm; and an elongate flexible, substantially non-stretchable connector having a first end attached to the first lever, a second end attached to the second lever, and length extending from the first end to the second end preventing the first and second levers from concurrently assuming their respective closed positions.

9. Apparatus according to claim 8, further comprising an intermediate portion of the connector extending between the first and second levers opposing the elongate body elastically coupled to the elongate body thereby biasing the first and second levers in their open positions, respectively.

10. Apparatus according to claim 9, wherein the intermediate portion is elastically coupled to the elongate body with elastic band material concurrently encircling the elongate body and the intermediate portion of the material.

11. Apparatus according to claim 10, wherein the elastic band material comprises at least one elastic band.

12. Apparatus according to claim 10, further comprising a stop attached to the intermediate portion of the connector on either side of the elastic band material capturing the elastic band material therebetween.

13. Apparatus according to claim 8, wherein the power source comprises at least one battery.

14. Apparatus according to claim 8, further comprising:

the elongate body having opposed sides; and the first and second levers confronting one of the opposed sides.

15. Apparatus, comprising:

an elongate body having opposed first and second ends;

a first grip formed at the first end of the elongate body;

a second grip formed at the second end of the elongate body;

first and second alarms and a power source carried by the elongate body;

a first contact carried by the first grip;

a second contact carried by the second grip;

a first lever, formed with a first lever contact, mounted to the elongate body for pivotal movement between an open position away from the first grip and a closed position toward the first grip engaging the first lever contact with the first contact closing a first circuit between the power source and the first alarm energizing the first alarm;

a second lever, formed with a first lever contact, mounted to the elongate body for pivotal movement between an open position away from the second grip and a closed position toward the second grip engaging the second lever contact with the second contact closing a second circuit between the power source and the second alarm energizing the second alarm; and an elongate flexible, substantially non-stretchable connector having a first end attached to the first lever, a second end attached to the second lever, and length extending from the first end to the second end preventing the first and second levers from concurrently assuming their respective closed positions.

16. Apparatus according to claim 15, further comprising an intermediate portion of the connector extending between the first and second levers opposing the elongate body and elastically coupled to the elongate body thereby biasing the first and second levers in their open positions, respectively.

17. Apparatus according to claim 16, wherein the intermediate portion is elastically coupled to the elongate body with elastic band material concurrently encircling the elongate body and the intermediate portion of the material.

18. Apparatus according to claim 17, wherein the elastic band material comprises at least one elastic band.

19. Apparatus according to claim 17, further comprising a stop attached to the intermediate portion of the connector on either side of the elastic band material capturing the elastic band material therebetween.

20. Apparatus according to claim 15, wherein the power source comprises at least one battery.

21. Apparatus according to claim 15, further comprising:

the elongate body having opposed sides; and the first and second levers confronting one of the opposed sides.

* * * * *